US011174717B2

(12) United States Patent
Li et al.

(10) Patent No.: US 11,174,717 B2
(45) Date of Patent: Nov. 16, 2021

(54) IN-SITU LEACHING MINING METHOD AND SYSTEM

(71) Applicant: Beijing Research Institute of Chemical Engineering and Metallurgy, China National Nuclear Corporation, Beijing (CN)

(72) Inventors: Zhaokun Li, Beijing (CN); Xuebin Su, Beijing (CN); Weimin Que, Beijing (CN); Genmao Zhou, Beijing (CN); Po Li, Beijing (CN); Yahui Tan, Beijing (CN); Zhiming Du, Beijing (CN); Baishi Hu, Beijing (CN); Hao Qin, Beijing (CN); Lizhi Yang, Beijing (CN)

(73) Assignee: Beijing Research Institute of Chemical Engineering and Metallurgy China National Nuclear Corporation

( * ) Notice: Subject to any disclaimer, the term of this patent is extended or adjusted under 35 U.S.C. 154(b) by 0 days.

(21) Appl. No.: 16/882,571

(22) Filed: May 25, 2020

(65) Prior Publication Data

US 2021/0032970 A1 Feb. 4, 2021

(30) Foreign Application Priority Data

Jul. 30, 2019 (CN) ..... 201910693382.3

(51) Int. Cl.

| | |
|---|---|
| ***E21B 43/28*** | (2006.01) |
| ***E21B 43/30*** | (2006.01) |
| *E21B 7/04* | (2006.01) |

(52) U.S. Cl.
CPC ..... *E21B 43/28* (2013.01); *E21B 43/305* (2013.01); *E21B 7/046* (2013.01)

(58) Field of Classification Search
CPC ..... E21B 43/283; E21B 43/28; E21B 43/281; E21B 43/285; E21B 43/29; E21B 43/292; E21B 43/30; E21B 43/305; E21B 7/046
(Continued)

(56) References Cited

U.S. PATENT DOCUMENTS 4,561,696 A * 12/1985 Graves ..... E21B 43/283 166/271
H614 H * 4/1989 Norman, Sr. ..... E21B 43/243 175/45

(Continued)

*Primary Examiner* — Janine M Kreck
*Assistant Examiner* — Michael A Goodwin
(74) *Attorney, Agent, or Firm* — Olive Law Group, PLLC

(57) ABSTRACT

The present invention discloses an in-situ leaching method and system. The ISL mining method provided by the present invention includes: constructing a vertical guiding well into an ore body; constructing a horizontal well towards the vertical guiding well, where the horizontal well includes a vertical section and a horizontal section; one end of the horizontal section is connected to the vertical section, and the other end of the horizontal section is connected to the vertical guiding well; constructing a plurality of vertical extraction wells towards the horizontal section; and simultaneously injecting lixiviant into the vertical section and the vertical guiding well by means of pressurized injection, and extracting leachate through the vertical extraction well. The ISL mining method and system provided by the present invention accomplish the injection through a horizontal well.

7 Claims, 4 Drawing Sheets

(58) Field of Classification Search
USPC ..... 299/5
See application file for complete search history.

(56) References Cited

U.S. PATENT DOCUMENTS

| | | | | |
|---|---|---|---|---|
| 8,998,345 | B2 * | 4/2015 | Haugen | E21B 43/28 299/5 |
| 2005/0087340 | A1 * | 4/2005 | Zupanick | E21B 41/0064 166/245 |
| 2005/0092483 | A1 * | 5/2005 | Vinegar | E21B 43/243 166/60 |
| 2006/0124360 | A1 * | 6/2006 | Lee | E21B 43/305 175/61 |
| 2010/0044101 | A1 * | 2/2010 | Cooper | E21B 43/305 175/2 |
| 2010/0225154 | A1 * | 9/2010 | Halverson | E21B 43/305 299/4 |
| 2016/0024904 | A1 * | 1/2016 | Zupanick | E21B 43/006 166/50 |
| 2016/0115774 | A1 * | 4/2016 | Hughes | E21C 37/00 299/5 |
| 2018/0156020 | A1 * | 6/2018 | Hughes | E21B 43/283 |

* cited by examiner

Prior Art (a) (b)

IN-SITU LEACHING MINING METHOD AND SYSTEM

CROSS REFERENCE TO RELATED APPLICATION

This application claims priority to Chinese Patent Application No. 201910693382.3, filed Jul. 30, 2019, the content of which is incorporated herein by reference in its entirety.

TECHNICAL FIELD

The present invention relates to the field of mining, and in particular, to an in-situ leaching (ISL) mining method and system.

BACKGROUND

In-situ leaching (ISL) is a main method of mining sandstone type uranium, which helps obtain about 70% of China's total uranium production. In China, a number of deposits carrying out ISL tests of uranium have progressed smoothly, and have initially met the requirements for industrial production. Therefore, the sandstone type uranium ore has become an important target for enhancing China's uranium production capacity, and has laid a foundation for in-depth research on various technologies of ISL in China.

Drilling is a key task for the ISL of uranium. Conventional vertical well mining involves drilling the wellbore vertically through the ore body. Since the contact area with the ore body and the control area of a single well are both small, it is necessary to build a dense well pattern, which requires a large-area well site and a high drilling cost. In addition, there is a problem of leaching dead angle in vertical well mining.

SUMMARY

An objective of the present invention is to provide an in-situ leaching (ISL) mining method and system, which have a low drilling cost and avoid a leaching dead angle.

To achieve the above purpose, the present invention provides the following technical solutions.

An ISL mining method includes:

constructing a vertical guiding well into an ore body;

constructing a horizontal well towards the vertical guiding well, wherein the horizontal well includes a vertical section and a horizontal section; one end of the horizontal section is connected to the vertical section, and the other end of the horizontal section is connected to the vertical guiding well;

constructing a plurality of vertical extraction wells towards the horizontal section;

simultaneously injecting a lixiviant into the vertical section and the vertical guiding well by means of pressurized injection, and extracting a leachate through the vertical extraction well.

Optionally, the horizontal well further includes a plurality of vertical radial wells, and the tops of the vertical radial wells communicate with the horizontal section.

Optionally, the vertical radial wells penetrate the ore body and a part of an aquifer.

Optionally, there are a plurality of horizontal wells; the horizontal section of each horizontal well is connected to the same vertical section; a plurality of vertical extraction wells are constructed in a fan-shaped area formed by adjacent horizontal sections.

Optionally, the horizontal sections are distributed radially with a common vertical section as a center, and the common vertical section is a vertical section that is connected to each of the horizontal sections.

Optionally, there are a plurality of horizontal wells; the horizontal section of at least two of the horizontal wells is connected to the same vertical section to form a cluster well unit; adjacent cluster well units communicate with each other through the vertical guiding well; a plurality of vertical extraction wells are constructed in a fan-shaped area formed by adjacent horizontal sections.

Optionally, the horizontal sections in each cluster well unit are distributed radially with a common vertical section as a center, and the common vertical section is a vertical section that is connected to each of the horizontal sections in the cluster well unit.

An ISL mining system includes:

a guiding well construction module, for constructing a vertical guiding well into an ore body;

a horizontal well construction module, for constructing a horizontal well towards the vertical guiding well, wherein the horizontal well includes a vertical section and a horizontal section; one end of the horizontal section is connected to the vertical section, and the other end of the horizontal section is connected to the vertical guiding well;

an extraction well construction module, for constructing a plurality of vertical extraction wells towards the horizontal section; and a leachate obtaining module, for simultaneously injecting a lixiviant into the vertical section and the vertical guiding well by means of pressurized injection, and extracting a leachate through the vertical extraction well.

According to specific examples provided by the present invention, the present invention discloses the following technical effects.

The present invention provides an ISL mining method, including: constructing a vertical guiding well into an ore body; constructing a horizontal well towards the vertical guiding well, where the horizontal well includes a vertical section and a horizontal section; one end of the horizontal section is connected to the vertical section, and the other end of the horizontal section is connected to the vertical guiding well; constructing a plurality of vertical extraction wells towards the horizontal section; and simultaneously injecting a lixiviant into the vertical section and the vertical guiding well by means of pressurized injection, and extracting a leachate through the vertical extraction well. The ISL mining method and system provided by the present invention accomplish the injection through a horizontal well. The present invention has the advantages of small required injection pressure, large injection volume, high sweep efficiency, large single-well leaching area, high leaching efficiency, high effective drilling footage and low drilling cost. Moreover, the horizontal well forms linear displacement in the ore body, avoiding a leaching dead angle.

BRIEF DESCRIPTION OF DRAWINGS

To describe the technical solutions in the examples of the present invention or in the prior art more clearly, the following briefly describes the accompanying drawings required for the examples. Apparently, the accompanying drawings in the following description show merely some examples of the present invention, and a person of ordinary skill in the art may still derive other accompanying drawings from these accompanying drawings without creative efforts.

DETAILED DESCRIPTION

The following clearly and completely describes the technical solutions in the examples of the present invention with reference to accompanying drawings in the examples of the present invention. Apparently, the described examples are merely a part rather than all of the examples of the present invention. All other examples obtained by a person of ordinary skill in the art based on the examples of the present invention without creative efforts shall fall within the protection scope of the present invention.

An objective of the present invention is to provide an in-situ leaching (ISL) mining method and system, which have a low drilling cost and avoid a leaching dead angle.

To make the above objectives, features, and advantages of the present invention more obvious and easy to understand, the present invention is described in further detail with reference to the accompanying drawings and detailed description.

Figure 1:
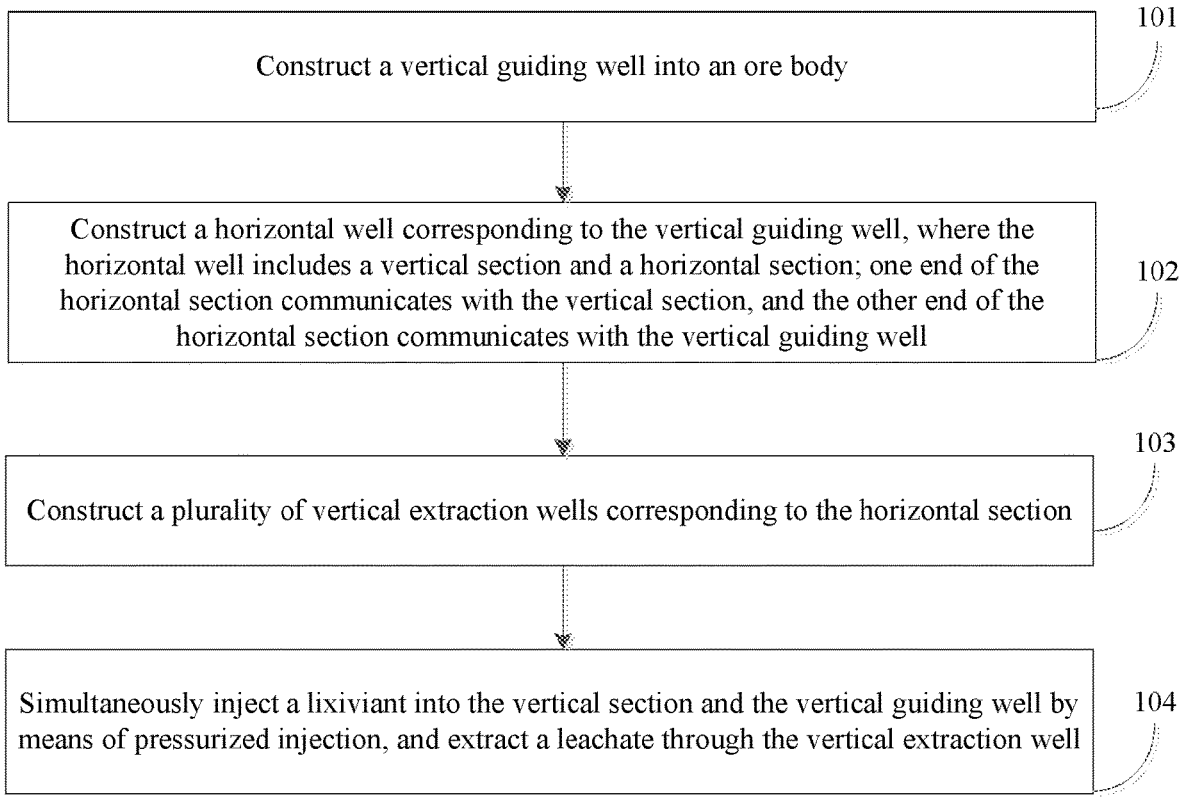
FIG. 1 is a flowchart of an ISL mining method according to an example of the present invention.
Figure 2:
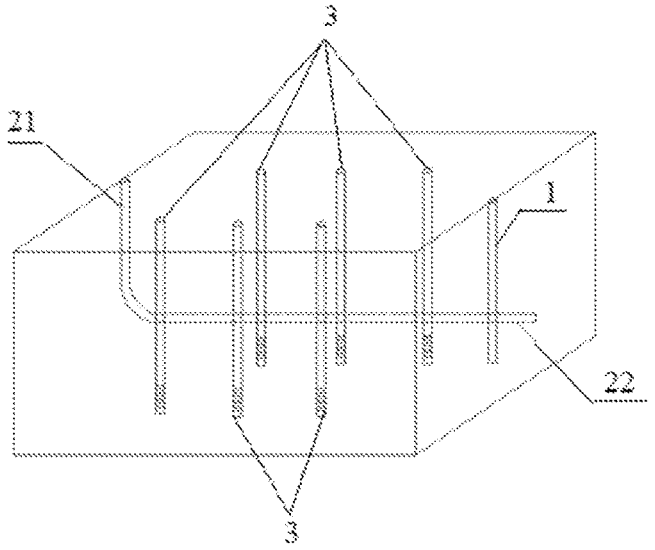
FIG. 2 is a layout diagram of a well pattern with a horizontal well for injection and a vertical well for extraction according to an example of the present invention.

FIG. 1 is a flowchart of an ISL mining method according to an example of the present invention. FIG. 2 is a layout diagram of a well pattern with a horizontal well for injection and a vertical well for extraction according to an example of the present invention. As shown in FIG. 1 and FIG. 2, the method includes:

Step 101: construct a vertical guiding well 1 into an ore body. The role of the vertical guiding well 1 is to determine information such as the position and thickness of the uranium ore body to steer horizontal well drilling.

Step 102: construct a horizontal well towards the vertical guiding well 1, where the horizontal well includes a vertical section 21 and a horizontal section 22; one end of the horizontal section 22 is connected to the vertical section 21, and the other end of the horizontal section 22 is connected to the vertical guiding well 1 by a steering device to form a U-shaped horizontal well.

Step 103: construct a plurality of vertical extraction wells 3 towards the horizontal section. In an actual application, a conventional ISL production well construction technique is adopted to construct the vertical extraction wells 3 at a distance of 15-100 m outside the horizontal section of the horizontal well.

Step 104: simultaneously inject a lixiviant into the vertical section 21 and the vertical guiding well 1 by means of pressurized injection, and extract a leachate through the vertical extraction well 3. In the present invention, since the horizontal section of the horizontal well is long, the lixiviant is injected into the ground from double ends of the U-shaped horizontal well. The vertical extraction well 3 extracts the target leachate through a submersible pump for subsequent processing.

The U-shaped horizontal well is used as an injection well, and the contact area between a filter and the ore body is large, which reduces a leaching dead angle and makes the solution and the ore body fully contact. The advantage of the vertical well as an extraction well is that it increases the total extracted volume. The present invention combines the characteristics of the horizontal well and the vertical well, thereby effectively improving the leaching efficiency of the ISL well pattern, and reducing the drilling cost.

Figure 3:
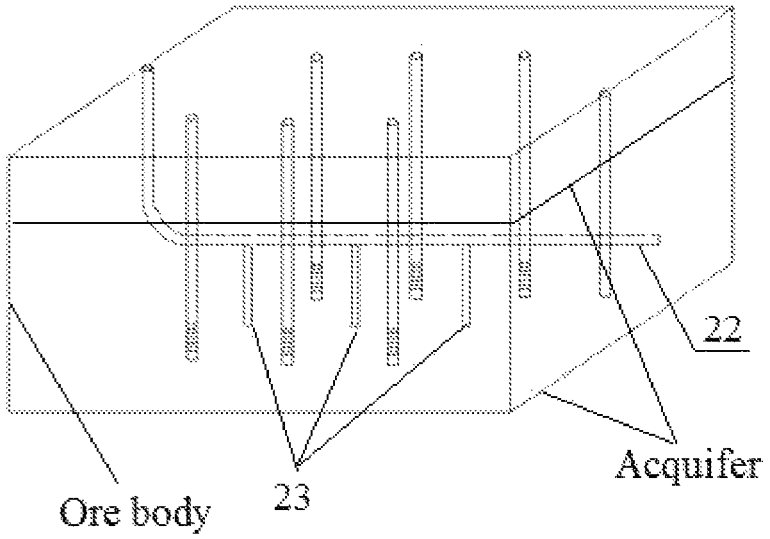
FIG. 3 is a layout diagram of a well pattern with a horizontal well (including a radial well) for injection and a vertical well for extraction according to an example of the present invention.

FIG. 3 is a layout diagram of a well pattern with a horizontal well (including a radial well) for injection and a vertical well for extraction according to an example of the present invention. As shown in FIG. 3, in order to improve the injection efficiency and reduce the leaching dead angle, the present invention uses an ultra-short radius (USR) radial well technique to construct a plurality of vertical radial wells 23. The tops of the vertical radial wells 23 communicate with the horizontal section 22. The vertical radial wells 23 penetrate the ore body and a part of an aquifer.

Figure 4:
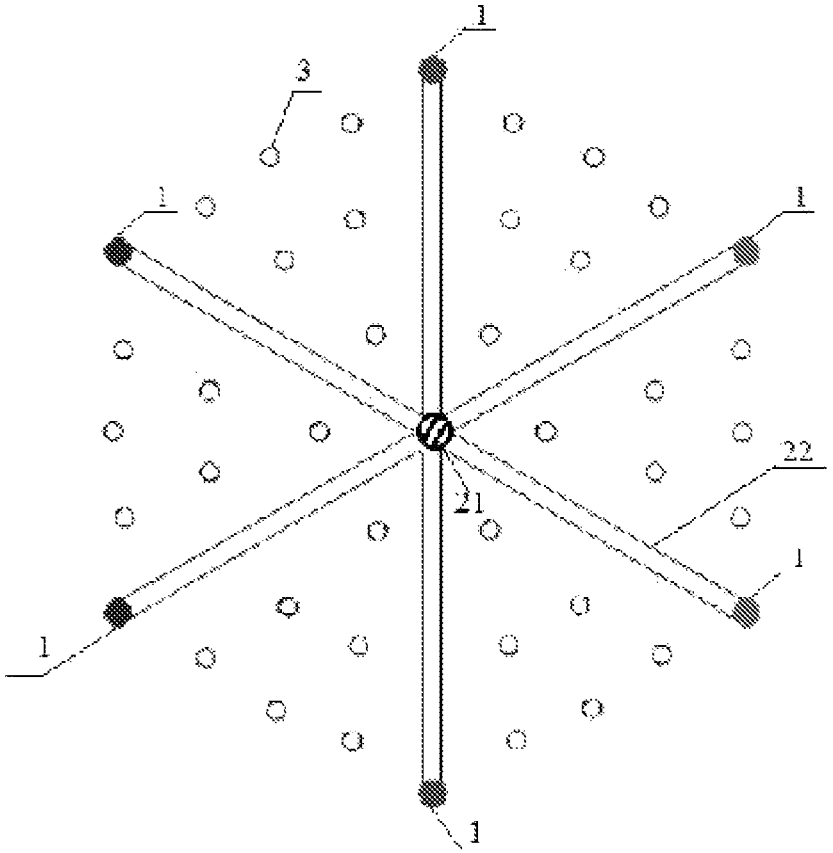
FIG. 4 is a layout diagram of a well pattern with a horizontal well cluster for injection and a vertical well for extraction according to an example of the present invention.

Preferably, a horizontal well cluster is used for injection and a vertical well is used for extraction. Horizontal wells are constructed toward a guiding well in different directions from a main vertical well of the well cluster. FIG. 4 is a layout diagram of a well pattern with a horizontal well cluster for injection and a vertical well for extraction according to an example of the present invention. As shown in FIG. 4, there are a plurality of horizontal wells; the horizontal section 22 of each horizontal well is connected to the same vertical section 21; a plurality of vertical extraction wells 3 are constructed in a fan-shaped area formed by adjacent horizontal sections 22. Specifically, the horizontal sections 22 are distributed radially with a common vertical section 21 as a center, and the common vertical section 21 is a vertical section that is connected to each of the horizontal sections.

Figure 5:
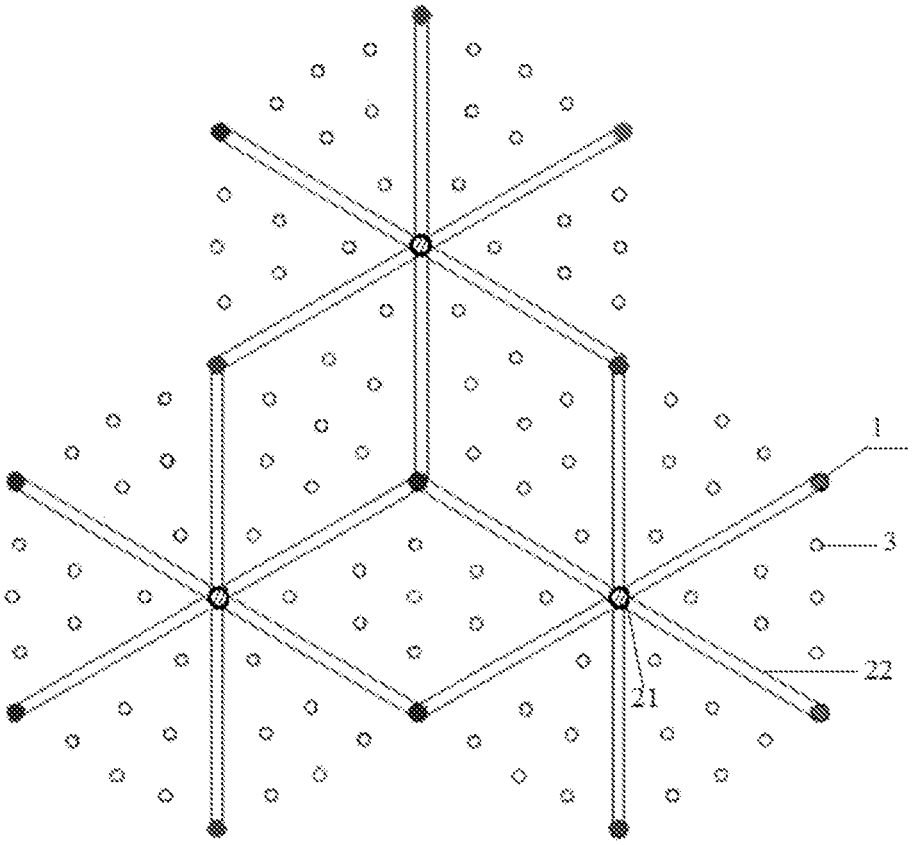
FIG. 5 is a layout diagram of another well pattern with a horizontal well cluster for injection and a vertical well for extraction according to an example of the present invention.

FIG. 5 is a layout diagram of another well pattern with a horizontal well cluster for injection and a vertical well for extraction according to an example of the present invention. As shown in FIG. 5, there are a plurality of horizontal wells; the horizontal section 22 of at least two of the horizontal wells is connected to the same vertical section 21 to form a cluster well unit; adjacent cluster well units communicate with each other through the vertical guiding well; a plurality of vertical extraction wells 3 are constructed in a fan-shaped area formed by adjacent horizontal sections 22. In this example, the horizontal sections 22 in each cluster well unit are distributed radially with a common vertical section 21 as a center, and the common vertical section is a vertical section that is connected to each of the horizontal sections in the cluster well unit.

Figure 6:
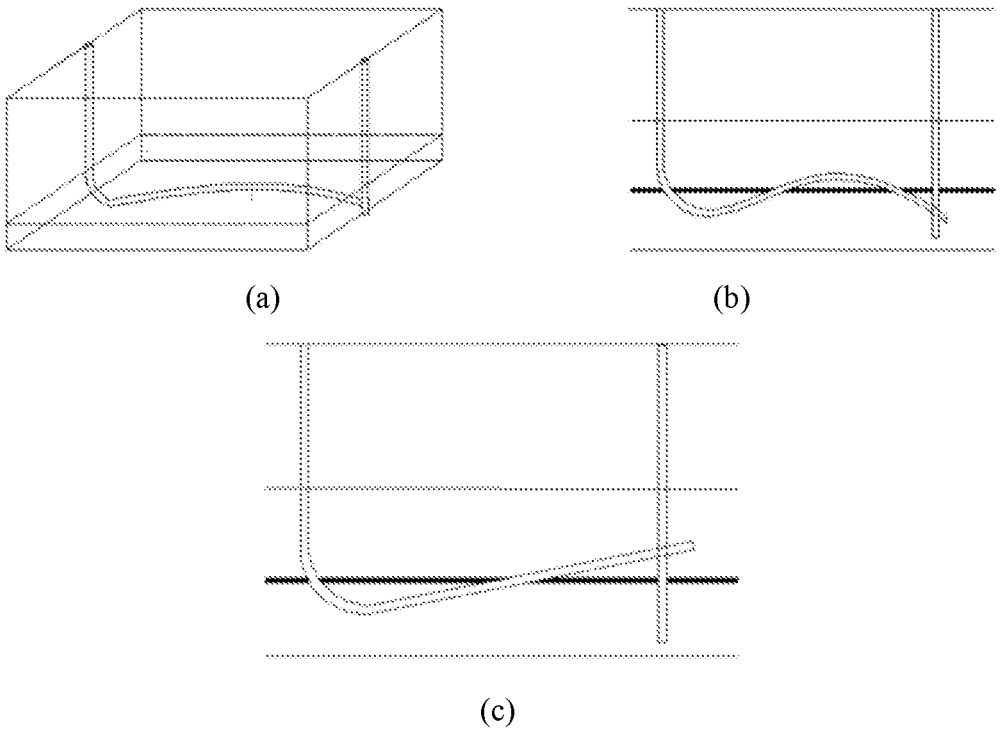
FIG. 6 is a layout diagram of a horizontal well according to an example of the present invention.

In a practical application, for a homogeneous sandstone type uranium deposit with an interbedded layer, the horizontal section of the U-shaped horizontal well is arranged at an upper part of the ore body and the filter of the vertical extraction well is arranged at a lower part of the ore body. This arrangement improves the leaching range of the horizontal well by a gravity field and a seepage field. For a sandstone type uranium deposit with an impermeable interbedded layer, there are two horizontal well arrangements, a sinusoidal arrangement shown in FIGS. 6(*a*) and (*b*), and a diagonal arrangement shown in FIG. 6(*c*).

For a homogeneous sandstone type uranium deposit, the vertical extraction wells can be evenly arranged on both sides of the horizontal section of the horizontal well, and the distance between the vertical extraction wells and the horizontal section is determined according to the permeability of the ore body, which is in the range of 15-100 m. For a non-homogeneous sandstone type uranium deposit, the vertical extraction wells are non-evenly arranged. The density of the vertical extraction wells is increased in an area with poor permeability, thereby increasing the formation pressure drop and seepage velocity in the area.

Figure 7:
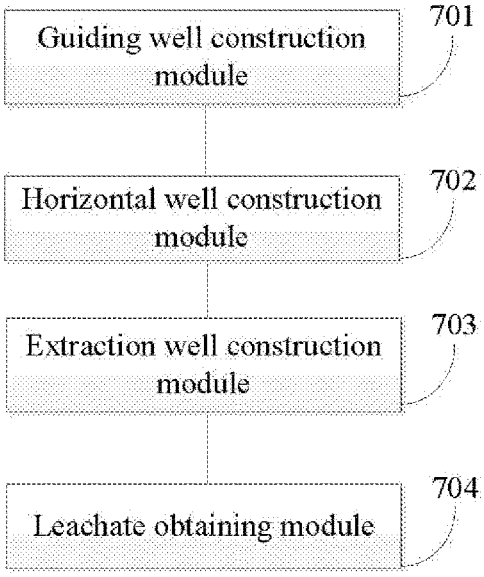
FIG. 7 is a structural block diagram of an ISL mining system according to an example of the present invention.

FIG. 7 is a structural block diagram of an ISL mining system according to an example of the present invention. As shown in FIG. 7, the ISL mining system includes:

a guiding well construction module 701, for constructing a vertical guiding well into an ore body;

a horizontal well construction module 702, for constructing a horizontal well towards the vertical guiding well, where the horizontal well includes a vertical section and a horizontal section; one end of the horizontal section is connected to the vertical section, and the other end of the horizontal section is connected to the vertical guiding well;

an extraction well construction module 703, for constructing a plurality of vertical extraction wells towards the horizontal section; and a leachate obtaining module 704, for simultaneously injecting a lixiviant into the vertical section and the vertical guiding well by means of pressurized injection, and extracting a leachate through the vertical extraction well.

Figure 8:
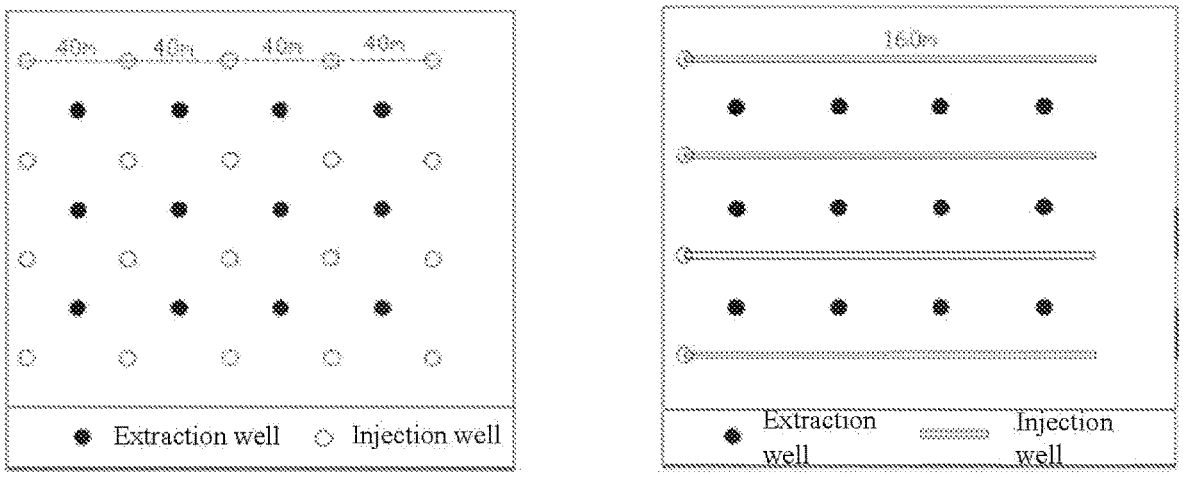
FIG. 8 is a diagram showing a comparison between a conventional five-spot vertical well pattern and a well pattern with a horizontal well for injection and a vertical well for extraction according to an example of the present invention.

FIG. 8 is a diagram showing a comparison between a conventional five-spot vertical well pattern and a well pattern with a horizontal well for injection and a vertical well for extraction according to an example of the present invention. FIG. 8(*a*) shows the conventional five-spot vertical well pattern, and FIG. 8(*b*) shows the well pattern with a horizontal well for injection and a vertical well for extraction. As shown in FIG. 8(*a*), there are a total of 12 extraction wells and correspondingly 20 injection wells in the conventional five-spot well pattern. As shown in FIG. 8(*b*), four horizontal wells as long as 160 m are used to replace the conventional vertical injection wells. For a 740 m deep deposit, the conventional five-spot vertical well pattern requires an investment of 20×740 m×950 yuan/m=14.06 million yuan in the drilling of injection holes. Compared with the conventional vertical injection well solution, the horizontal injection well solution requires only 4×900 m×2500 yuan/m=9 million yuan, which reduces the cost by 5.06 million yuan, accounting for 36%.

The above costs are calculated based on a 740 m buried depth and a 160 m long horizontal section. If the deposit is deeper or the horizontal section is longer, the horizontal wells replacing the conventional vertical wells as injection wells will reduce more costs. Table 1 shows the cost-saving horizontal injection well solution under different buried depths of the deposit and different lengths of the horizontal well.

TABLE 1

Comparison of costs under different buried depths and different lengths of horizontal section

| Depth of ore body | Length of Horizontal Section (m) | Number of Vertical Wells Replaced | Cost of Horizontal Wells (10,000 RMB) | Total Cost of Vertical Wells (10,000 RMB) | Cost Reduced |
|---|---|---|---|---|---|
| 700 m | 120 | 4 | 205 | 252 | 18.7% |
| | 200 | 6 | 225 | 378 | 40.5% |
| | 280 | 8 | 245 | 504 | 51.4% |
| | 360 | 10 | 265 | 630 | 57.9% |
| 800 m | 120 | 4 | 230 | 288 | 20.1% |
| | 200 | 6 | 250 | 432 | 42.1% |
| | 280 | 8 | 270 | 576 | 53.1% |
| | 360 | 10 | 290 | 720 | 59.7% |
| 900 m | 120 | 4 | 255 | 324 | 21.3% |
| | 200 | 6 | 275 | 486 | 43.4% |
| | 280 | 8 | 295 | 648 | 54.5% |
| | 360 | 10 | 315 | 810 | 61.1% |

It can be seen from FIG. 1 that the horizontal wells replacing the conventional vertical injection wells reduces more costs as the buried depth and the length of the horizontal section are increasing. For example, for a 900 m deep deposit, if a horizontal well with a horizontal section as long as 360 m is used to replace 10 injection wells as deep as 900 m, the construction cost of the injection holes can have a significant reduction by 61.1%. This provides a cost-effective ISL mining method for a deeper deposit such as a sandstone type uranium deposit.

The ISL mining method and system provided by the present invention accomplish the injection through a horizontal well. The present invention has the advantages of small required injection pressure, large injection volume, high sweep efficiency, large single-well leaching area, high leaching efficiency, high effective drilling footage and low drilling cost. Moreover, the horizontal well forms linear displacement in the ore body, avoiding a leaching dead angle.

Each example of the present specification is described in a progressive manner, each example focuses on the difference from other examples, and the same and similar parts between the examples may refer to each other.

In this paper, several examples are used for illustration of the principles and examples of the present invention. The description of the foregoing examples is used to help illustrate the method of the present invention and the core principles thereof. In addition, those skilled in the art can make various modifications in terms of specific examples and scope of application in accordance with the teachings of the present invention. In conclusion, the content of the present specification shall not be construed as a limitation to the present invention.

What is claimed is:

1. An in-situ leaching (ISL) mining method, wherein the method comprises:

constructing a vertical guiding well into an ore body;

constructing a horizontal well towards the vertical guiding well, wherein the horizontal well comprises a vertical section and a horizontal section; one end of the horizontal section is connected to the vertical section, and another end of the horizontal section is connected to the vertical guiding well;

constructing a plurality of vertical extraction wells towards the horizontal section;

simultaneously injecting a lixiviant into the vertical section and the vertical guiding well by means of pressurized injection, and extracting a leachate through the plurality of vertical extraction wells.

2. The ISL mining method according to claim 1, wherein the horizontal well further comprises a plurality of vertical radial wells, and tops of the vertical radial wells communicate with the horizontal section.

3. The ISL mining method according to claim 2, wherein the plurality of vertical radial wells penetrate the ore body and a part of an aquifer.

4. The ISL mining method according to claim 1, wherein there are a plurality of horizontal wells; the horizontal section of each horizontal well is connected to a common vertical section; the plurality of vertical extraction wells are constructed in a fan-shaped area formed by adjacent horizontal sections.

5. The ISL mining method according to claim 4, wherein the horizontal sections are distributed radially with the common vertical section as a center, and the common vertical section is a vertical section that is connected to each of the horizontal sections.

6. The ISL mining method according to claim 1, wherein there are a plurality of horizontal wells; the horizontal section of at least two of the horizontal wells is connected to a common vertical section to form a cluster well unit; adjacent cluster well units communicate with each other through the vertical guiding well; a plurality of vertical extraction wells are constructed in a fan-shaped area formed by adjacent horizontal sections.

7. The ISL mining method according to claim 6, wherein the horizontal sections in each cluster well unit are distributed radially with a common vertical section as a center, and the common vertical section is a vertical section that is connected to each of the horizontal sections in the cluster well unit.

* * * * *